US008091742B2

(12) United States Patent
Haimi

(10) Patent No.: US 8,091,742 B2
(45) **Date of Patent: *Jan. 10, 2012**

(54) PUMP LID

(75) Inventor: Shlomo Haimi, Or Akiva (IL)

(73) Assignee: Captech Ltd., Or Akiva (IL)

( * ) Notice: Subject to any disclaimer, the term of this patent is extended or adjusted under 35 U.S.C. 154(b) by 524 days.

This patent is subject to a terminal disclaimer.

(21) Appl. No.: 12/342,092

(22) Filed: Dec. 23, 2008

(65) Prior Publication Data

US 2010/0155429 A1 Jun. 24, 2010

(51) Int. Cl.

| | |
|---|---|
| ***B67D 7/66*** | (2010.01) |
| ***B65D 83/00*** | (2006.01) |
| ***B65B 31/04*** | (2006.01) |
| *B67D 1/08* | (2006.01) |

(52) U.S. Cl. ..... 222/383.2; 222/401; 222/321.7; 222/152; 141/65

(58) Field of Classification Search ..... 222/383.2, 222/401, 321.7, 368, 152, 3, 1; 215/228; 220/212, 231, 203.06; 141/65, 94, 95
See application file for complete search history.

(56) References Cited

U.S. PATENT DOCUMENTS

| | | | | |
|---|---|---|---|---|
| 4,823,968 | A * | 4/1989 | Handzlik | 215/228 |
| 5,071,020 | A * | 12/1991 | Reutter | 220/203.06 |
| 5,152,425 | A * | 10/1992 | Baudin | 222/1 |
| 5,406,992 | A * | 4/1995 | Miramon | 141/65 |
| 5,469,979 | A * | 11/1995 | Chiou | 215/228 |
| 5,944,212 | A * | 8/1999 | Chang | 220/212 |
| 5,992,666 | A * | 11/1999 | Wu | 220/212 |
| 6,131,753 | A * | 10/2000 | Lynch | 215/228 |
| 6,375,024 | B1 * | 4/2002 | Park | 215/262 |
| 6,637,321 | B2 * | 10/2003 | Wang | 99/472 |
| 7,757,725 | B2 * | 7/2010 | Wang et al. | 141/65 |

* cited by examiner

*Primary Examiner* — Kevin P Shaver
*Assistant Examiner* — Nicholas Weiss
(74) *Attorney, Agent, or Firm* — Mark M. Friedman

(57) ABSTRACT

A pump lid assembly for use with a container, having a rotatable pump cylinder configuration and a pump piston mechanically associated with the rotatable pump cylinder configuration such that at least a portion of the piston is deployed within the pump cylinder, thereby defining a variable pump volume. The pump piston is configured with a substantially cylindrical piston wall having an interior surface and an exterior surface such that at least a portion of the interior surface is configured for releasable attachment to the container such that when the lid is attached to the container and at least a portion of the piston circumscribes the part of the container. At least a portion of the exterior surface of the piston wall interacts with the rotatable pump cylinder configuration and the association is such that rotation of the rotatable pump cylinder configuration generates linear motion of the rotatable pump cylinder configuration.

6 Claims, 10 Drawing Sheets

PUMP LID

FIELD AND BACKGROUND OF THE INVENTION

The present invention relates to pump lids for use with containers and, in particular, it concerns improvements to such lids.

Issued U.S. Pat. No. 6,973,945 and pending U.S. Patent Application No. 2005/0274734, both to the present inventor, describe different embodiments of a container lid that include a pumping configuration such that rotational movement of one component of the pump lid is translated into linear movement of either the piston element or the cylinder element of the pump lid. The intention of such a pump lid is that ambient air may be pumped into the container, thereby creating a pressurized state within the container. Alternatively, air may be pumped out of the interior volume of the container, thereby creating of state of at least partial vacuum within the container.

The present invention comes to provide certain improvement to these lids which reduce the overall size of the pump lid and simplify manufacture and assembly of the pump lid.

There is therefore a need for an improved pump lid for use on a container.

SUMMARY OF THE INVENTION

The present invention is an improved pump lid for use on a container.

According to the teachings of the present invention there is provided, a pump lid assembly for use with a container, the lid assembly comprising: (a) a rotatable pump cylinder configuration; and (b) a pump piston mechanically associated with said rotatable pump cylinder configuration such that at least a portion of said piston is deployed within said pump cylinder, thereby defining between them a variable pump volume, said pump piston configured with a substantially cylindrical piston wall having an interior surface and an exterior surface such that at least a portion of said interior surface is configured for releasable attachment to the container and at least a portion of said exterior surface interacts with said rotatable pump cylinder configuration; wherein said association is such that rotation of said rotatable pump cylinder configuration generates linear motion of said rotatable pump cylinder configuration.

According to a further teaching of the present invention, said exterior surface of said cylindrical piston wall includes at least one pin element extending laterally therefrom.

According to a further teaching of the present invention, said rotatable pump cylinder configuration includes a substantially cylindrical cylinder wall that defines a pump cylinder region in which said pump piston is deployed, said substantially cylindrical cylinder wall configured with a wave shaped groove into which said pin element extends.

According to a further teaching of the present invention, said rotatable pump cylinder configuration includes at least two components that when assembled define between them said wave shaped groove.

According to a further teaching of the present invention, said two components, when assembled, define between them said wave shaped groove and are configured such that a first component includes a top wall and a side wall of said wave shaped groove and a second component includes a bottom wall of said wave shaped groove.

According to a further teaching of the present invention, said exterior surface of said cylindrical piston wall includes a resilient lip that extends around a periphery of said cylindrical wall and provides an airtight seal between said rotatable pump cylinder configuration and said pump piston element during an expansion stroke, and when under pressure of a compression stroke, allows air to pass between said rotatable pump cylinder configuration and said pump piston element.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is an improved pump lid for use on a container.

The principles and operation of an improved pump lid according to the present invention may be better understood with reference to the drawings and the accompanying description.

By way of introduction, as mentioned above, the present invention comes to improve the inventor's prior version of a pump lid as disclosed in U.S. Pat. No. 6,973,945 and U.S. Patent Application No. 2005/0274734, both of which are incorporated by reference as if they were fully set forth herein. These improvements include a shorter profile, an increase in piston diameter, thereby increasing suction and the compression capacity of the pump and ease of manufacture.

The shortened profile is accomplished by configuring the container attachment arrangement in a hollow region of the interior of the piston. That is to say, the pump lid of the present invention is deployed on a container such that when the lid is attached to the container at least a portion of the piston circumscribes the part of the container. In the previous versions of the pump lid, the pump arrangement extends above the seat portion that is configured for attachment to the container. The increase in piston diameter is the result of having the piston circumscribe the container.

Figure 7:
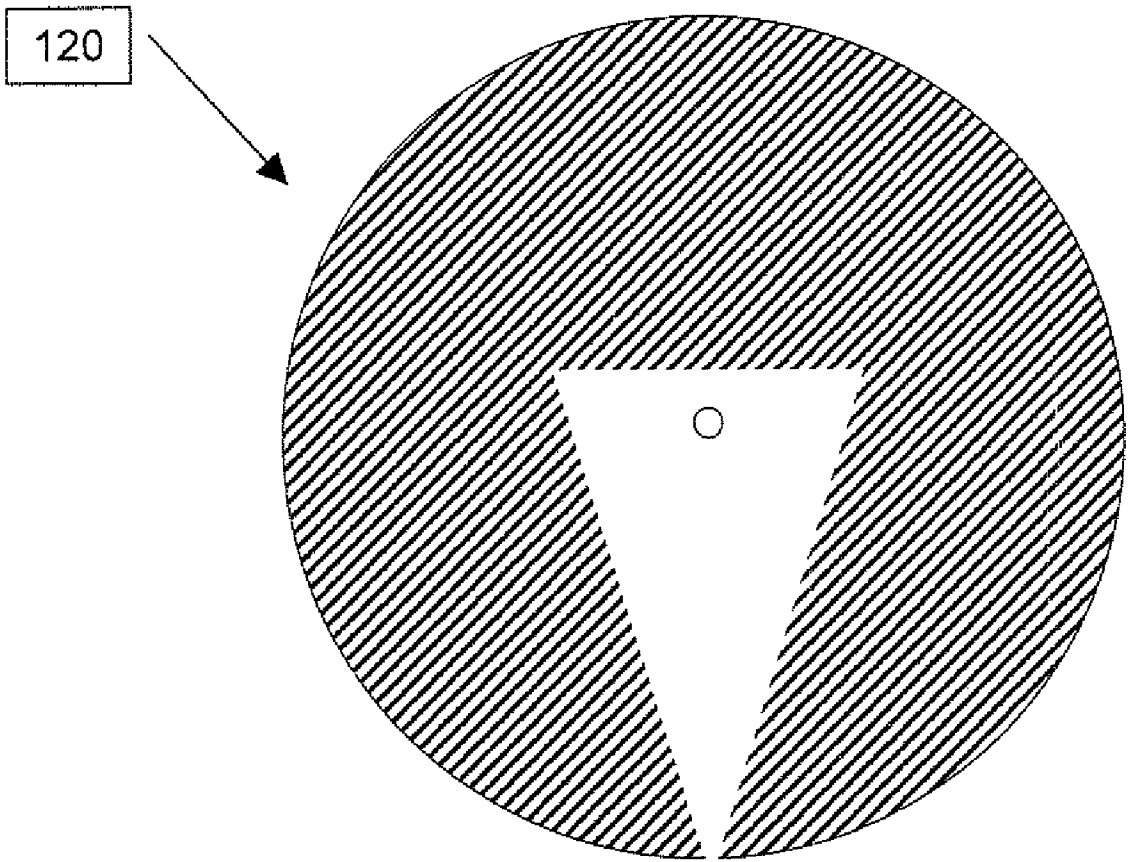
FIG. 7 is a schematic bottom view of a valve sticker constructed and operational according to the teachings of the present invention.

Manufacture of the pump lid of the present invention is simplified in several ways, including configuring the rotatable cylinder in two pieces such that the wave shaped groove is realized by the joining together of the two pieces, as will be discussed below in detail. Further, the valves may be configured with lip valves (also known as sticker valves), as illustrated in FIG. 7, that are installed over valve openings.

It will be appreciated that similar to the previous versions of a pump lid, rotational movement of one component of the pump lid is translated into linear movement of another element of the pump lid. Further, the pump lid of the present invention may be configured to pump air out of the interior volume of the container, thereby creating of state of at least partial vacuum within the container. Alternatively, ambient air may be pumped into the container, thereby creating a pressurized state within the container.

Figure 1:
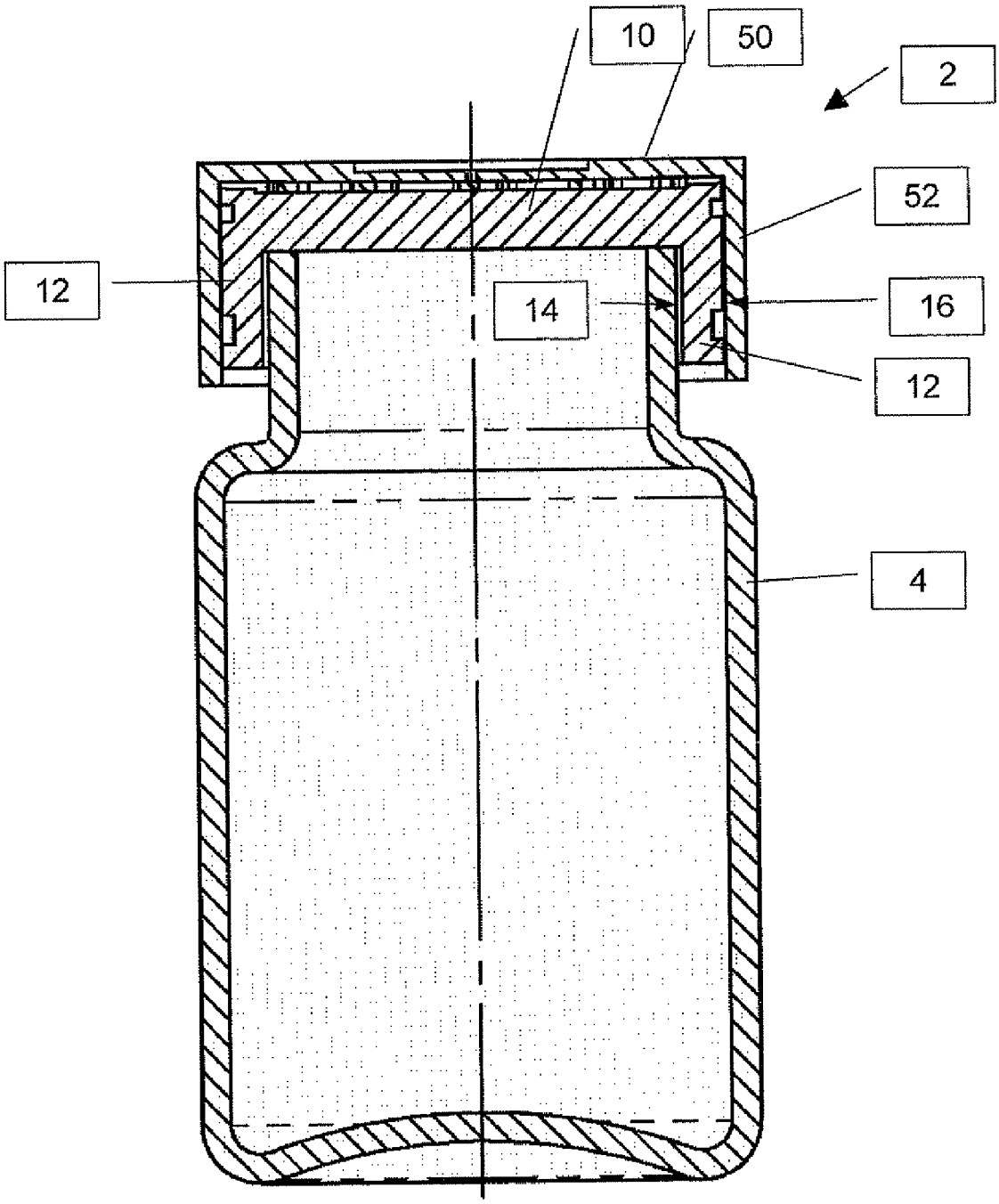
FIG. 1 is a schematic side sectional view illustrating the main components of a pump lid constructed and operational according to the teachings of the present invention, deployed on a container.
Figure 2:
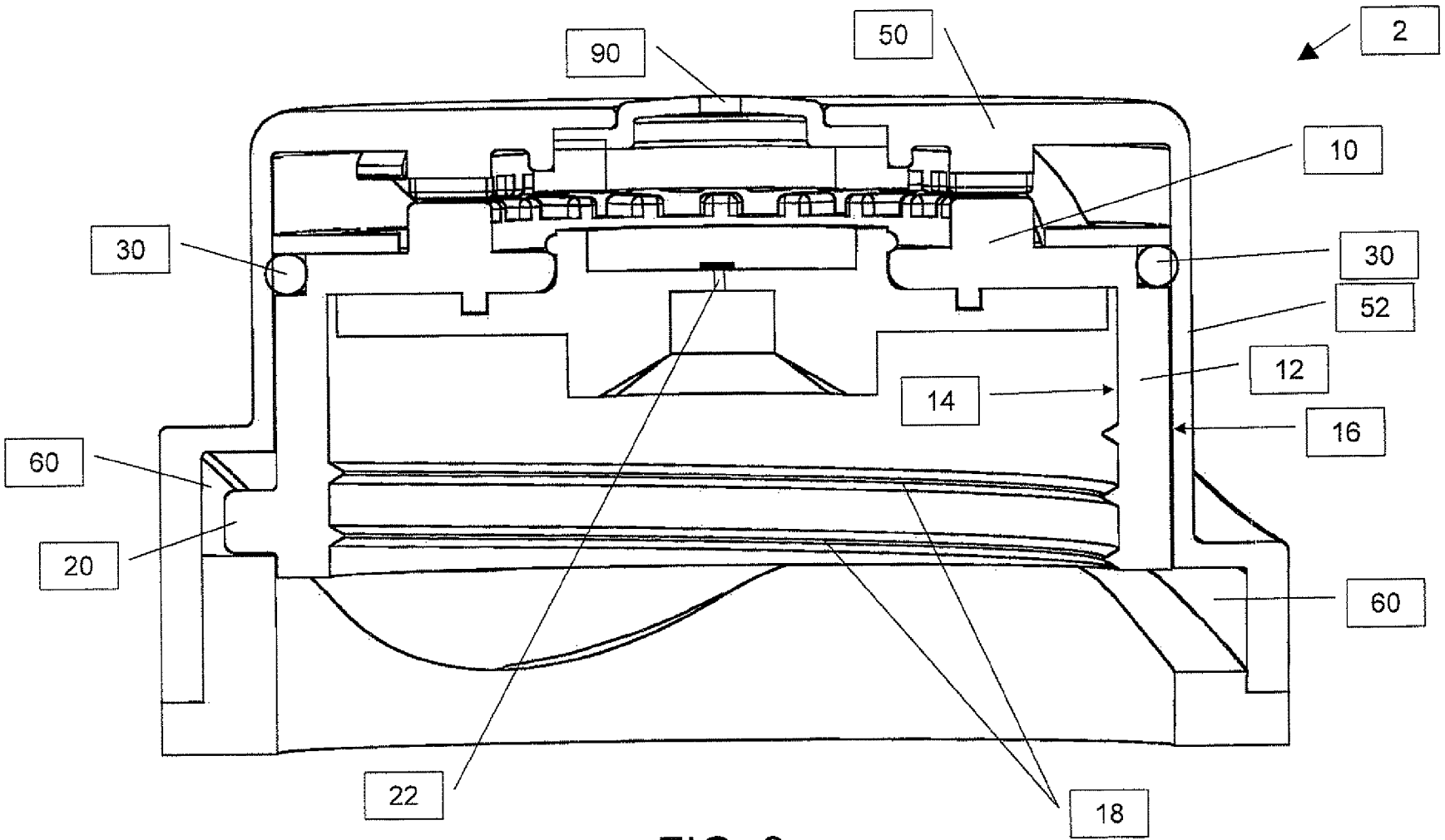
FIG. 2 is a cross sectional elevation of a first preferred embodiment of a pump lid constructed and operational according to the teachings of the present invention showing the cylinder at the end of a compression stroke.
Figure 3:
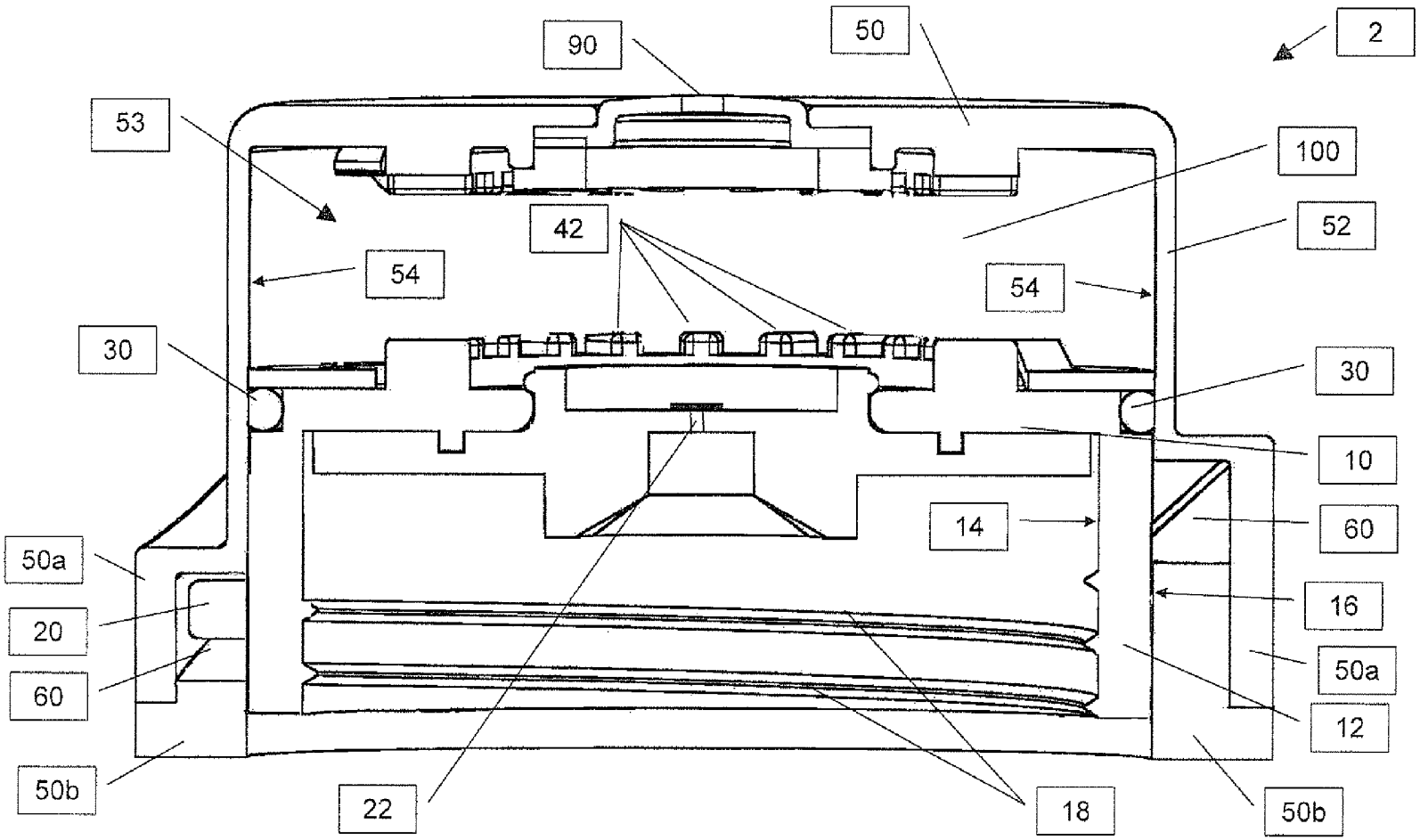
FIG. 3 is a cross sectional elevation of the embodiment of FIG. 2, showing the cylinder at the end of an expansion stroke.
Figure 4:
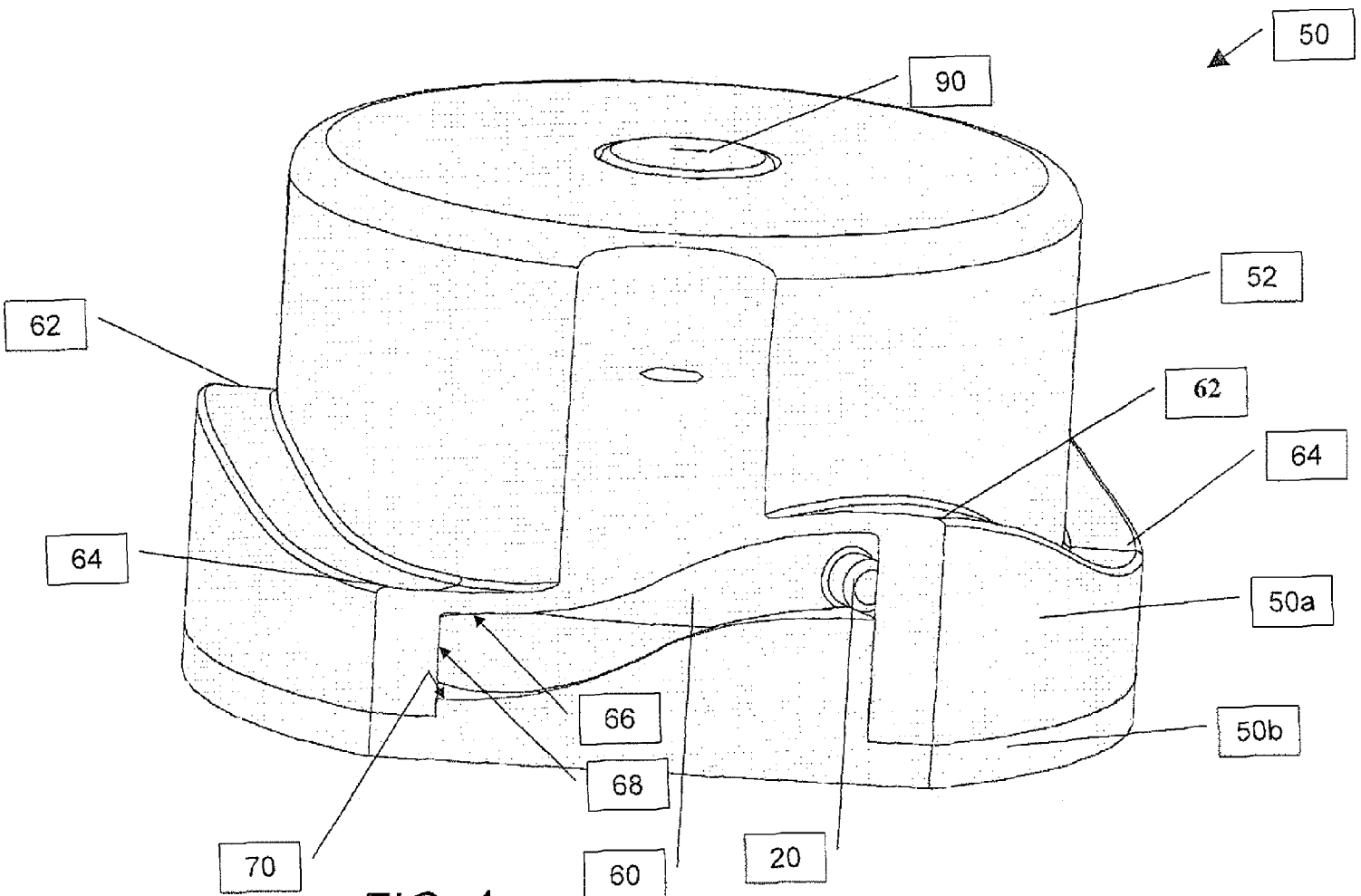
FIG. 4 is a partial cut-away view of the embodiment of FIG. 2, showing the association of the wave-shaped groove and the pump actuation pin.
Figure 5:
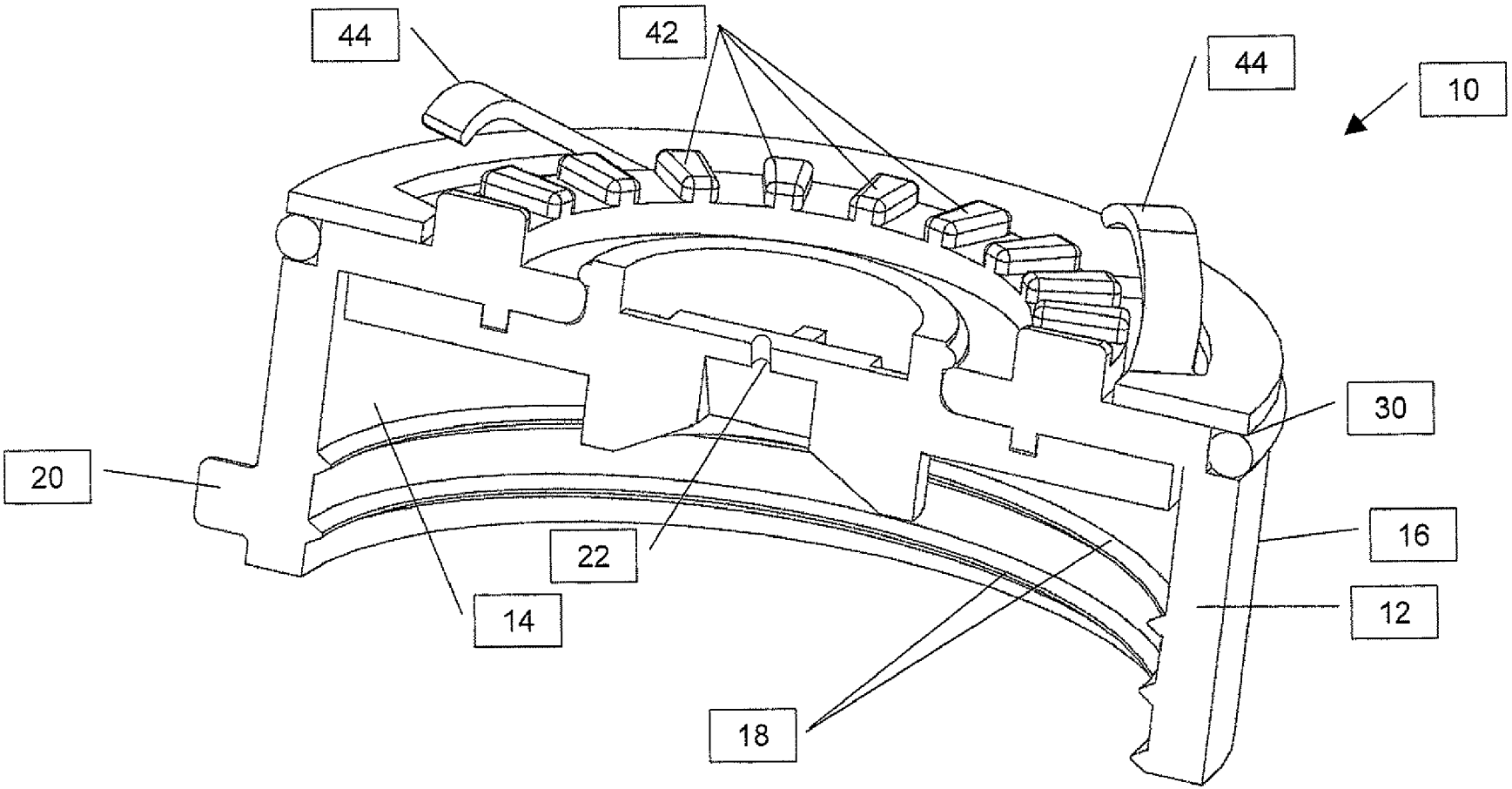
FIG. 5 is an isometric cross section of the pump piston of FIG. 3.
Figure 6:
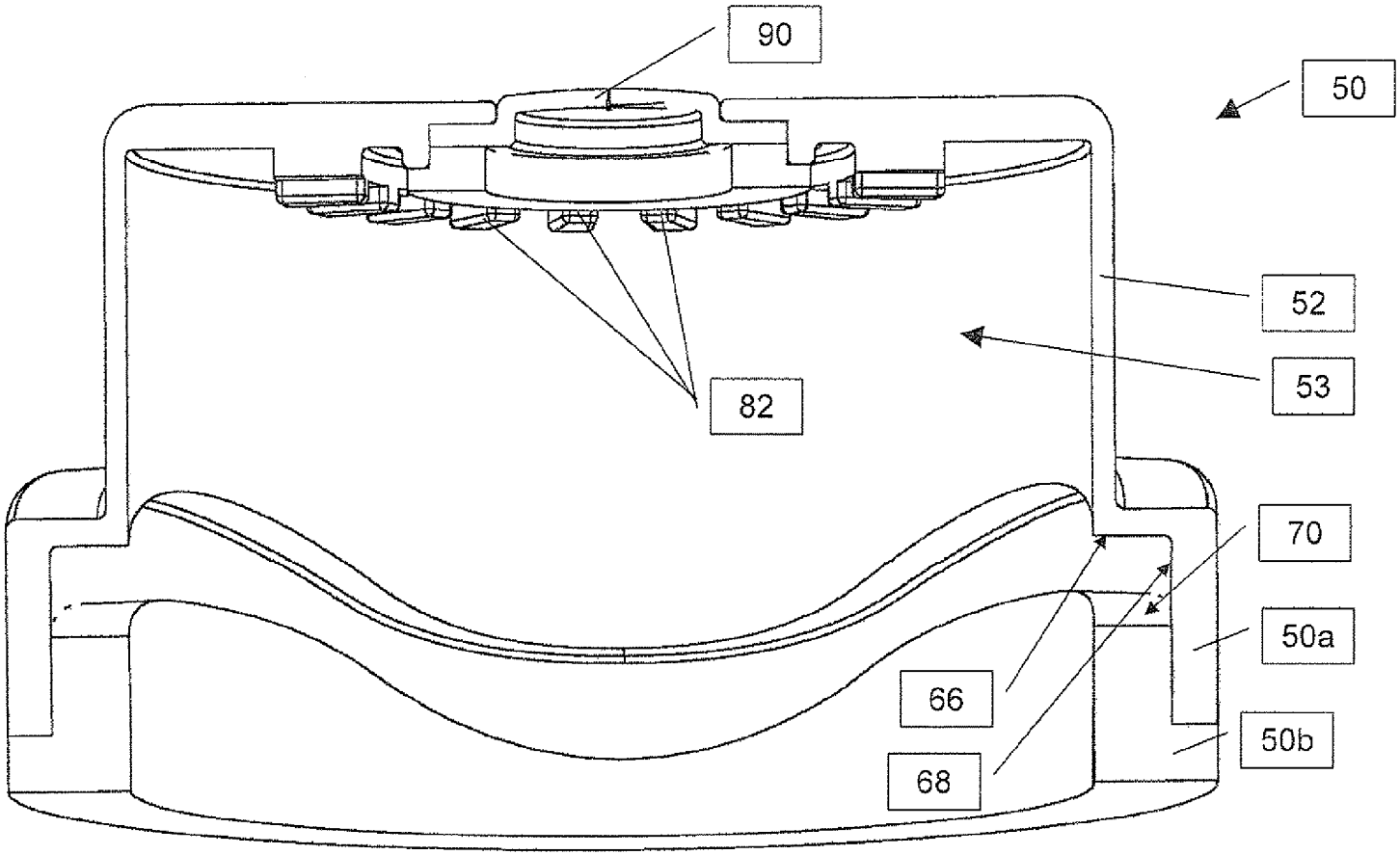
FIG. 6; is an isometric cross sectional side view of the rotatable pump cylinder of the pump lid embodiment of FIG. 2

Referring now to the drawings, FIG. 1 illustrates a pump lid 2 of the present invention deployed on a container 4, illustrated here as a bottle. The pump piston element 10 is configured with a substantially cylindrical wall 12 having an interior surface 14 and an exterior surface 16. At least a portion of the interior surface 14 is configured for the releasable attachment to the container 4 and at least a portion of the exterior surface 16 interacts with the rotatable pump cylinder 50. Therefore, the pump piston element 10 is deployed on the container 4 such that at least a portion of piston wall 12 circumscribes a portion of the container. The exterior of the pump lid 2 is the rotatable pump cylinder configuration 50 that includes a substantially cylindrical cylinder wall 52 that defines a pump cylinder region 53 (best seen in FIGS. 3, 6 and 9) in which the pump piston is deployed. Therefore, when assembled, and the pump piston 10 is deployed within the pump cylinder 50 (best seen in FIG. 3), the two components define between them a variable pump volume 100. This configuration minimizes the height above the container 4 to which the pump lid 2 of the present invention extends.

FIGS. 2-6 illustrate in greater detail a fully assembled pump lid 2 of the present invention In this embodiment, releasable attachment of the pump piston element 10 to the container is effected by screw threads 18 configured on the interior surface 14 of the piston wall 12. The screw threads 18 are configured to engage corresponding threads on the container, such that the piston is screwed onto the container so as to circumscribe at least a portion of the container.

The exterior surface 16 of the cylindrical wall 12 includes at least one pump actuation pin element 20 extending laterally therefrom. The interior surface 54 of the cylinder wall 52 is configured with a wave-shaped groove 60 that extends over an arc of 360° around the interior surface 54.

The rotatable pump cylinder configuration 50 is deployed over the pump piston element 10 with pump actuation pin element 20 extending into wave-shaped groove 60.

Relative linear displacement between the pump piston element 10 and the rotatable pump cylinder configuration 50, so as to perform the pumping operation, is achieved by rotating the pump cylinder configuration 50 about the pump piston element 10. The interaction of the wave-shaped groove 60 with the pump actuation pin element 20 translates the rotational movement of the rotatable pump cylinder configuration 50 into linear movement of the rotatable pump cylinder configuration 50.

The embodiment illustrated in FIGS. 2-6 has three pump actuation pin elements 20 equally spaced about the exterior surface 16 of the cylindrical wall 12. Wave-shaped groove 60 on the interior surface 54 of the cylinder wall 52 is configured with a corresponding three wave forms. That is, a wave crest 62 and trough 64 for each pump actuation pin elements 20. It will be appreciated, however, that this is for illustrative purposes only and that varying the number of pump actuation pin elements 20 and the number of associated wave crests 62 and troughs 64 is within the scope of the present invention It will be understood the number of pumping strokes (the combination of an expansion stroke and a compression stroke) per each rotation of the rotatable pump cylinder configuration 50 is equal to the number of waves forms configured in the wave shaped groove. Therefore, the embodiment of the present invention illustrated in FIGS. 2-6 will produce three linear pumping strokes per one rotation of the rotatable pump cylinder configuration 50.

Preferably, the individual components of the pump lid 2 are produced from plastics by, for non-limiting example, injection molding. For ease of manufacture, the rotatable pump cylinder configuration 50 is fabricated from two separately molded sections, a cylinder top section 50*a* and a cylinder bottom section 50*b* that when assembled define between them the wave shaped groove 60. As is clearly illustrated in FIGS. 2-4 and 6, cylinder top section 50*a* includes the top wall 66 and the side wall 68 of said wave shaped groove 60 and the cylinder bottom section 50*b* the bottom wall 70 of the wave shaped groove 60.

In operation, as the rotatable pump cylinder configuration 50 is rotated it is also linearly displaced. As the rotatable pump cylinder configuration 50 is displaced away from the pump piston element 10 the variable pump volume 100 increases and air is drawn out of the container through a one-way valve arrangement 22 configured in the pump piston element 10. As the rotatable pump cylinder configuration 50 is displaced toward the pump piston element 10 the variable pump volume 100 decreases and air is forced out of the variable pump volume 100 through one-way valve arrangement 90 configured in the top of rotatable pump cylinder configuration 50. It will be appreciated that O-ring 30 provides an air-tight seal between the rotatable pump cylinder configuration 50 and the pump piston element 10.

It will be understood that substantially any suitable one-way valve arrangement known in the art may be used. By non-limiting example, one-way valve arrangement 90 may be configured with a lip valve (also known as a sticker valve) 120 covering the opening (see FIG. 7).

Figure 8:
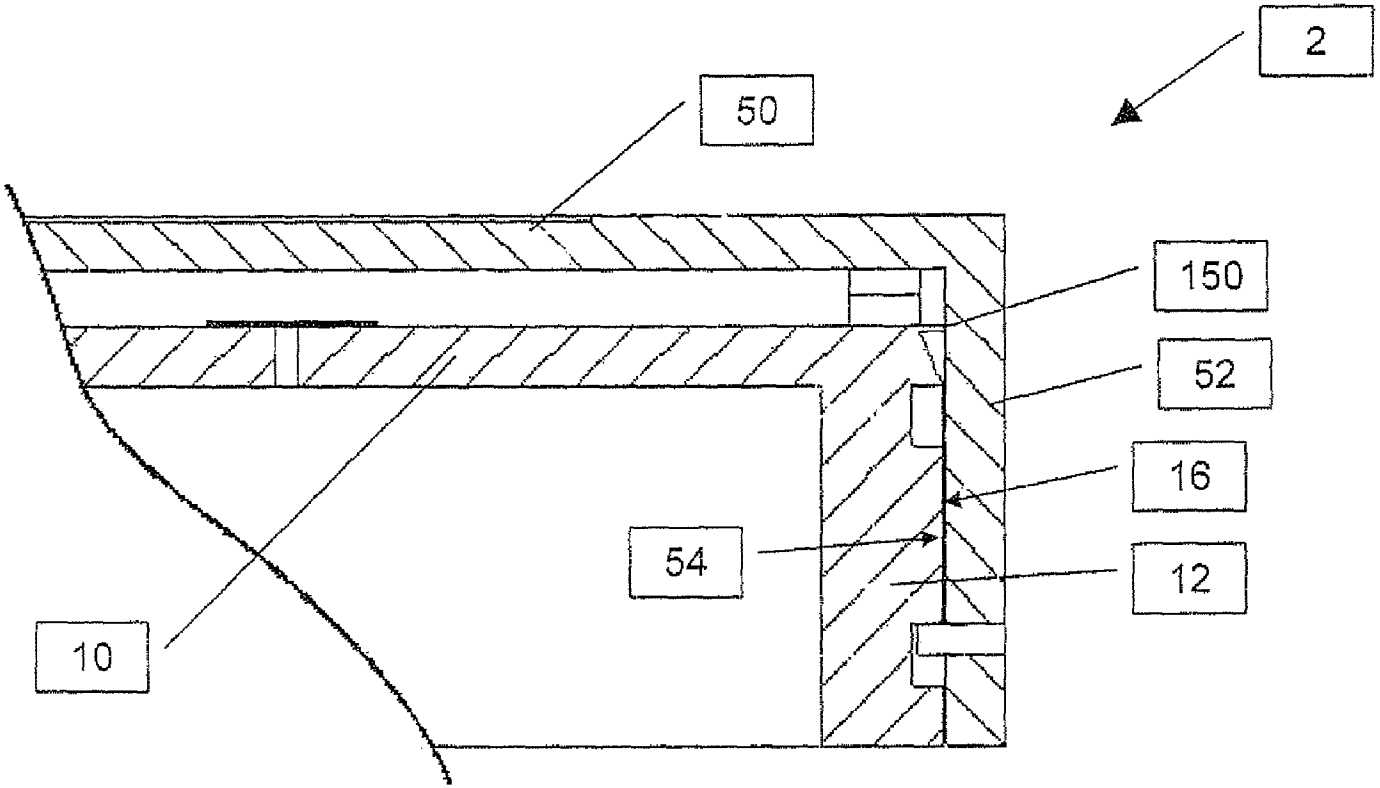
FIG. 8 is a schematic cross sectional elevation of a pump lid constructed and operational according to the teachings of the present invention, showing an alternative valve configuration at the end of a compression stroke.
Figure 9:
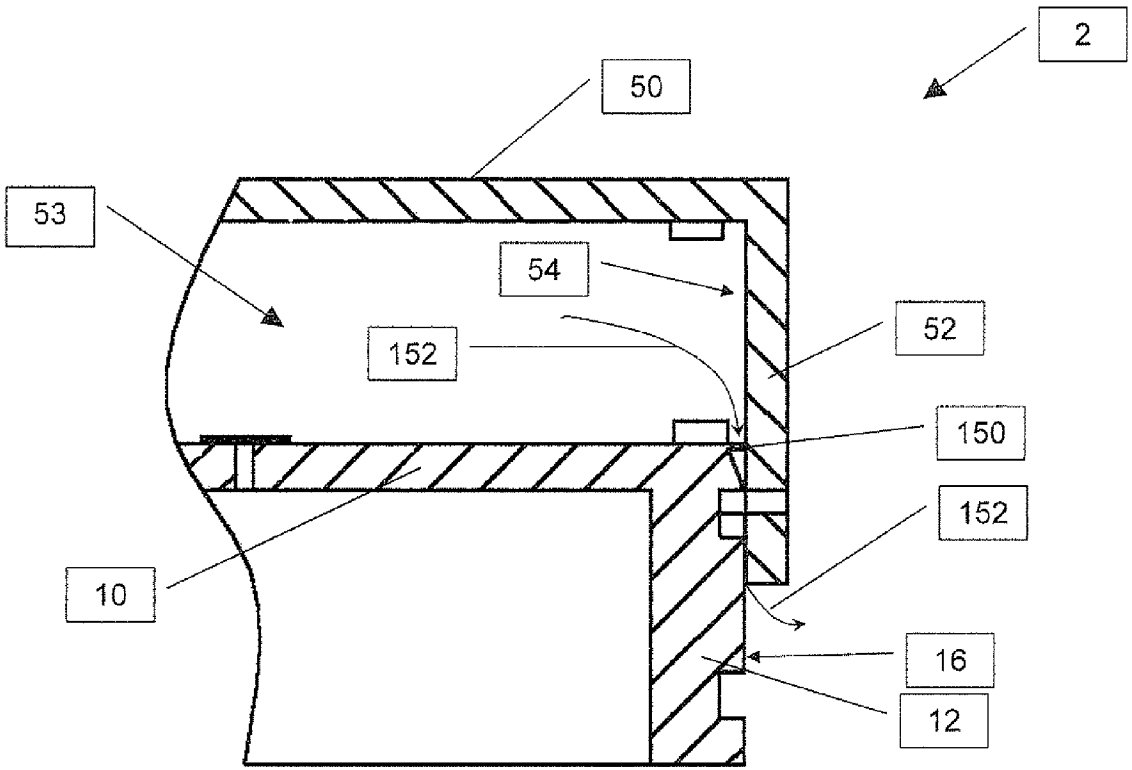
FIG. 9 is a schematic cross sectional elevation of the pump lid of FIG. 8 at the end of an expansion stroke.

Alternatively, as illustrated in FIGS. 8 and 9, both one-way valve arrangement 90 and O-ring 30 may be replaced by configuring the exterior surface 16 of the cylindrical wall 12 so as to include a resilient lip 150 that extends around the periphery of the cylindrical wall 12 and provides an air-tight seal between the rotatable pump cylinder configuration 50 and the pump piston element 10 during an expansion stroke, yet when under the pressure of a compression stroke, allows air to pass and escape between the walls of the rotatable pump cylinder configuration 50 and the pump piston element 10 as illustrated by the arrows 152.

Also illustrated are two childproof arrangements. The child-proof arrangement of FIGS. 2, 3, 5 and 6 includes circularly spaced apart teeth 42 configured in the top surface of the pump piston element 10. Corresponding teeth 82 are configured on the interior surface of the top wall of the rotatable pump cylinder configuration 50. During normal pumping operation, spring elements 44 configured in the top surface of the pump piston element 10 prevent teeth 42 and teeth 82 from meshing. In order to remove pump lid 2 from container 4 the rotatable pump cylinder configuration 50 is pressed toward the pump piston element 10 so as to mesh teeth 42 and teeth 82 at which time rotation of pump cylinder configuration 50 will also rotate the pump piston element 10, thereby unscrewing it from the container 2. It will be understood that wave-shaped groove 60 is configured such that the distance between the top wall 62 and bottom wall 66 accommodates such displacement of the pump cylinder configuration 50.

Figure 10:
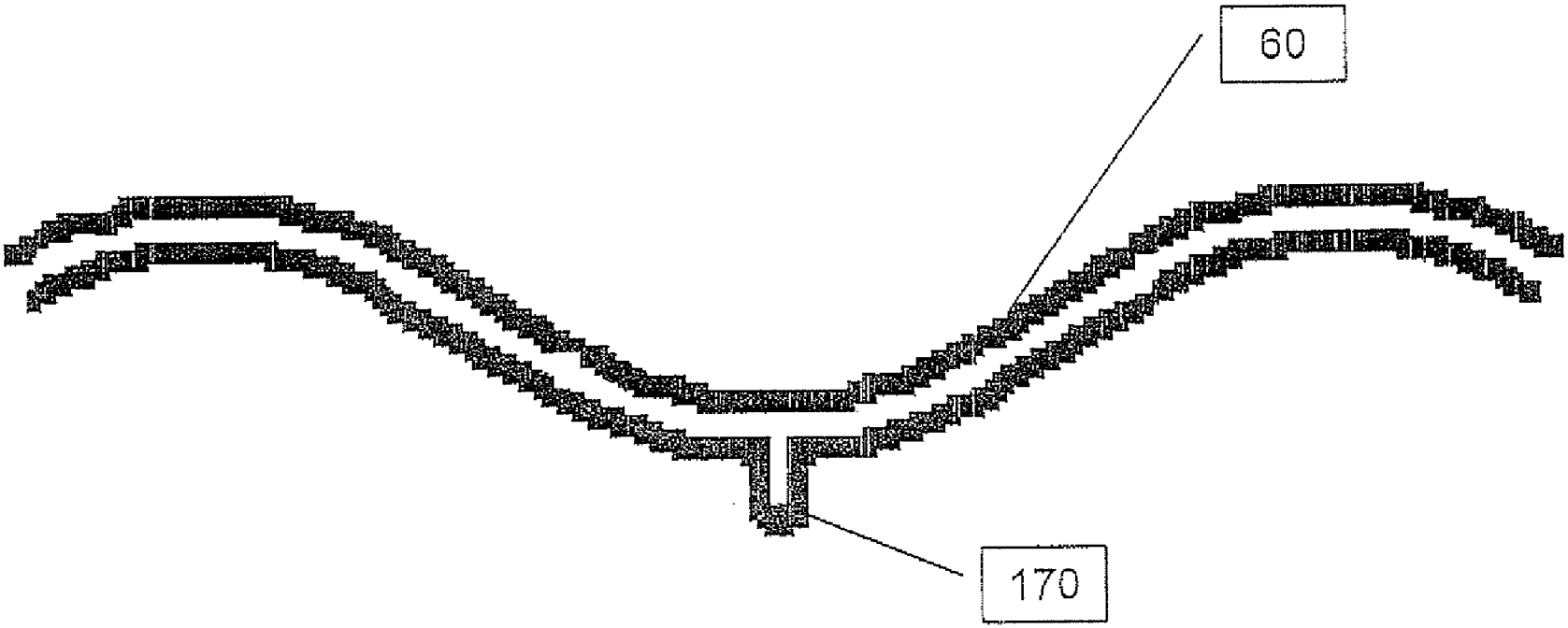
FIG. 10 is a schematic illustration of an alternative child proof arrangement constructed and operational according to the teachings of the present invention.

An alternative child-proof arrangement is illustrated in FIG. 10. As seen here, each trough of the wave-shaped groove 60 is configured with a slot 170 into which pump actuation pin elements 20 are pressed. Once the pump actuation pin elements 20 are in the slots 170 rotation of pump cylinder configuration 50 will also rotate the pump piston element 10, thereby unscrewing it from the container 2.

It will be appreciated that the above descriptions are intended only to serve as examples and that many other embodiments are possible within the spirit and the scope of the present invention.

What is claimed is:

1. A pump lid assembly for use with a container, the lid assembly comprising:

(a) a rotatable pump cylinder configuration; and (b) a pump piston mechanically associated with said rotatable pump cylinder configuration such that at least a portion of said piston is deployed within said pump cylinder, thereby defining between them a variable pump volume, said pump piston configured with a substantially cylindrical piston wall having an interior surface and an exterior surface such that at least a portion of said interior surface is configured for releasable attachment to the container and at least a portion of said exterior surface interacts with said rotatable pump cylinder configuration;

wherein said association is such that rotation of said rotatable pump cylinder configuration generates linear motion of said rotatable pump cylinder configuration.

2. The pump lid of claim 1, wherein said exterior surface of said cylindrical piston wall includes at least one pin element extending laterally therefrom.

3. The pump lid of claim 2, wherein said rotatable pump cylinder configuration includes a substantially cylindrical cylinder wall that defines a pump cylinder region in which said pump piston is deployed, said substantially cylindrical cylinder wall configured with a wave shaped groove into which said pin element extends.

4. The pump lid of claim 3, wherein said rotatable pump cylinder configuration includes at least two components that when assembled define between them said wave shaped groove.

5. The pump lid of claim 4, wherein said two components, when assembled, define between them said wave shaped groove and are configured such that a first component includes a top wall and a side wall of said wave shaped groove and a second component includes a bottom wall of said wave shaped groove.

6. The pump lid of claim 2, wherein said exterior surface of said cylindrical piston wall includes a resilient lip that extends around a periphery of said cylindrical wall and provides an air-tight seal between said rotatable pump cylinder configuration and said pump piston element during an expansion stroke, and when under pressure of a compression stroke, allows air to pass between said rotatable pump cylinder configuration and said pump piston element.

* * * * *